United States Patent [19]

Pamlin et al.

[11] Patent Number: 4,773,229

[45] Date of Patent: Sep. 27, 1988

[54] METHOD FOR REFRIGERATION SYSTEMS

[75] Inventors: Roland Pamlin, Handen; Lars Sjöholm, Sollentuna, both of Sweden

[73] Assignee: Svenska Rotor Maskiner AB, Stockholm, Sweden

[21] Appl. No.: 934,446

[22] PCT Filed: Mar. 21, 1986

[86] PCT No.: PCT/SE86/00124

§ 371 Date: Nov. 12, 1986

§ 102(e) Date: Nov. 12, 1986

[87] PCT Pub. No.: WO86/05576

PCT Pub. Date: Sep. 25, 1986

[30] Foreign Application Priority Data

Mar. 22, 1985 [SE] Sweden ..... 8501439

[51] Int. Cl.[4] ..... F25B 43/02

[52] U.S. Cl. ..... 62/84; 62/471

[58] Field of Search ..... 62/471, 510, 505, 84; 418/201

[56] References Cited

U.S. PATENT DOCUMENTS 3,150,277 9/1964 Chubb et al. ..... 62/505 X 3,931,718 1/1976 Haselden ..... 62/510 X 4,261,180 4/1981 Nozawa et al. ..... 62/505 X 4,375,156 3/1983 Shaw ..... 418/201 X

*Primary Examiner*—William E. Wayner

*Attorney, Agent, or Firm*—Frishauf, Holtz, Goodman & Woodward

[57] ABSTRACT

The invention relates to a method for a refrigerant system having a circulation circuit comprising a screw compressor (1), a condenser (4), an expansion valve (5) and an evaporator (6). In a refrigerant process, in which an oil injected compressor is connected it is impossible to prevent oil from flowing together with the refrigerant out into the circulation circuit, which among others impairs the operation of the evaporator. According to the invention a drastic reduction of the amount of circulating oil has been obtained together with an improved cooling of the compressor by supplying the low pressure side of the compressor with refrigerant liquid with a pressure and temperature lower than the pressure and temperature of the refrigerant in the condenser in such amounts per unit of time that the required cooling and sealing of the compressor is obtained, the effect of the circulating oil being restricted merely to lubricating.

3 Claims, 1 Drawing Sheet

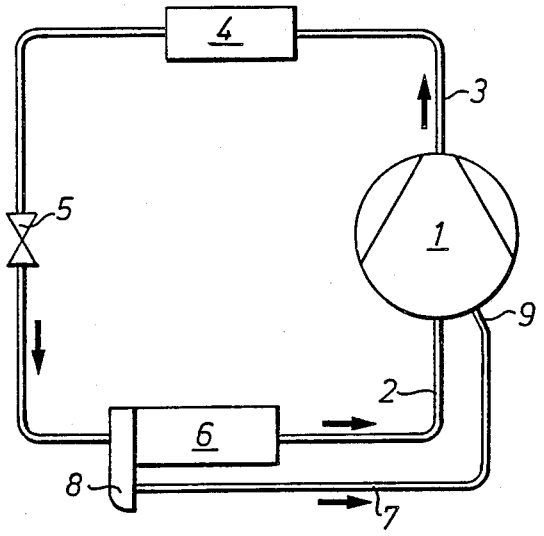
4
3
5
1
9
2
6
8
7

METHOD FOR REFRIGERATION SYSTEMS

This invention relates to a method for a refrigeration system for cooling, sealing and lubrication of the working chamber of a screw compressor forming a part of the system, which screw compressor together with a condenser, an expansion valve and an evaporator forms a circulation circuit, in which a refrigerant and a small amount of oil are circulating.

In a refrigeration system of this or a similar type, in which oil for lubrication of the compressor's working chamber can flow out into the circulation system via an oil separator situated on the compressor's high pressure side, the oil will sooner or later end up in the evaporator. Because the refrigerant evaporates from the liquid surface, an enrichment of the oil will occur in liquid form. This impairs the evaporators efficiency, partly through the shifting boiling point, partly through the impaired coefficient of heat transfer.

In practice this is handled today through different systems of oil returning, for example, pumping to a closed thread in a screw compressor. In an oil injected compressor, this flood must, however, not be so large that the compressor's discharge temperature begins to come close to the condensing temperature with the ensuing risk for condensation of the refrigerant in the oil separator and dilution of the oil.

The object of the invention is to completely or partly eliminate these drawbacks in a simple way. This has, according to the invention, been achieved in that the outlet of the compressor is connected directly to the inlet of the condenser for supplying the refrigerant and the total amount of oil from the compressor to the condenser. Refrigerant liquid containing oil with a pressure and temperature lower than the pressure and temperature of the refrigerant and oil in the condenser, preferably close to or the same pressure and temperature as in the evaporator, is supplied to the low pressure side of the compressor with such amounts per unit of time, that essentially all of the intended cooling and sealing is secured by means of the refrigerant liquid, the amount of oil present being restricted to a value which is required for proper lubrication of the rotors. A collection of refrigerant liquid containing oil takes place, preferably, in a pipe between the expansion valve and the evaporator, or from the evaporator, after which the refrigerant liquid and oil is transported to the compressor's low pressure side through a particular pipe, preferably to a thread with reduced pressure in relation to the inlet pressure, which can be achieved by delaying the opening of the thread towards the inlet.

The idea of the invention is consequently to have a thorough reduction of the oil flow passing through the compressor and also a thorough increase of the amount of refrigerant injected into the compressor.

By means of the reduced oil flood, the oil separator can be dispensed with and, consequently, a meaningfully lower discharge temperature can therefore be allowed. A larger amount of refrigerant liquid can therefore be injected in the compressor for sealing and temperature control. This liquid is undercooled in relation to the inlet temperature and can therefore be injected into the compressor's low pressure side without the risk of worsening of the volumeter.

The result of this is an improved efficiency because of better sealing and cooling than what is normally achieved during oil injection for the same goal. Besides a controlled low discharge temperature is achieved which gives a smaller difference in thermal deformation between inlet and outlet and even improved lifetime for the oil and refrigerant. An improved efficiency for the evaporator which counteracts the oil enrichment can even be achieved.

The invention is further clarified in the following with reference to the attached drawing, which schematically shows a refrigeration system, with which an example of the method according to the invention is applied.

The drawing shows a screw compressor 1 with inlet 2 and outlet 3 which later is directly connected to a condenser 4 which, together with an expansion valve 5 and an evaporator 6 connected to the compressor's inlet, forms a cooling circuit containing a refrigerant with a small amount of oil which is required for lubrication of the compressor's working chamber and the rotors located therein.

According to the invention there is also a pipe 7, which connects a collection container 8 by the inlet side of the evaporator with the inlet 2 of the compressor or, when necessary, with a thread 9 with lower pressure than the inlet pressure.

The refrigeration system differs from conventional refrigeration systems, partly because of the absence of an oil separator and a feed back of cooling and sealing oil from the oil separator to the compressor, and partly through the transporting of cold refrigerant liquid containing a small amount of oil from the container 8 past the evaporator 6 through the pipe 7 to the compressor 1. As mentioned previously, the amount of oil is sufficient for lubrication of the compressor, but not more, and the refrigerant liquid is sufficient for cooling and sealing the compressor during boiling off.

The expansion valve 5 is designed, as known per se, to control the cooling cycle such that refrigerant liquid is always available in the container 8.

The requirements for the pressure and temperature of the refrigerant liquid can be satisfied in other ways than those described. The refrigerant can thus be diverted from the pipe between the condenser 4 and the expansion valve 5 and after pressure reduction and proper cooling supplied to the compressor's 1 low pressure side in a suitable way.

We claim:

1. A method for a refrigeration system for cooling, sealing and lubrication of the working chamber of a screw compressor (1) forming a part of the system, which screw compressor together with a condenser (4), an expansion valve (5) an evaporator (6) and a suction line form a circulation circuit in which a refrigerant and a small amount of oil are circulating, comprising the steps of:

adding oil to a liquid refrigerant in an amount restricted to a value which is just required for proper lubrication of rotors of the screw compressors;

collecting liquid refrigerant containing oil in a container between the expansion valve (5) and the evaporator (6); and supplying the liquid refrigerant containing oil from said container through a particular pipe (7) separate from the suction line to a low pressure side (2, 9) of the compressor with such amounts per unit of time that essentially all of the intended cooling and sealing is achieved by means of the refrigerant liquid.

2. The method of claim 1, wherein the step of supplying the liquid refrigerant containing oil through a particular pipe (7) to a low pressure side (2, 9) of the compressor is preferably to a thread (9) with reduced pressure.

3. The method of claim 1, wherein the step of supplying the liquid refrigerant containing oil through a particular pipe (7) to a low pressure side (2, 9) of the compressor bypasses said evaporator.

* * * * *